US009018554B2

(12) United States Patent
Chen

(10) Patent No.: US 9,018,554 B2
(45) Date of Patent: Apr. 28, 2015

(54) LUMINESCENT KEYSWITCH MODULE AND KEYBOARD THEREOF

(71) Applicant: Chicony Electronics Co., Ltd., New Taipei (TW)

(72) Inventor: Chien-Shuo Chen, Taoyuan County (TW)

(73) Assignee: Chicony Electronics Co., Ltd., New Taipei (TW)

( * ) Notice: Subject to any disclaimer, the term of this patent is extended or adjusted under 35 U.S.C. 154(b) by 222 days.

(21) Appl. No.: 13/645,718

(22) Filed: Oct. 5, 2012

(65) Prior Publication Data

US 2014/0061017 A1 Mar. 6, 2014

(30) Foreign Application Priority Data

Aug. 31, 2012 (TW) ..... 101216820 U

(51) Int. Cl.
*H01H 9/00* (2006.01)
*H01H 13/83* (2006.01)
*H01H 3/12* (2006.01)

(52) U.S. Cl.
CPC ..... *H01H 13/83* (2013.01); *H01H 3/125* (2013.01); *H01H 2219/014* (2013.01); *H01H 2219/056* (2013.01); *H01H 2219/06* (2013.01); *H01H 2219/062* (2013.01)

(58) Field of Classification Search
CPC ..... H01H 13/023; H01H 3/125; H01H 9/00
USPC ..... 200/310, 314
See application file for complete search history.

(56) References Cited

U.S. PATENT DOCUMENTS

| | | | | |
|---|---|---|---|---|
| 7,086,768 | B2 * | 8/2006 | Suwa et al. | 362/555 |
| 7,388,167 | B2 * | 6/2008 | Liao et al. | 200/310 |
| 2011/0298696 | A1 * | 12/2011 | Gu et al. | 345/102 |
| 2012/0120080 | A1 * | 5/2012 | Wang et al. | 345/520 |

* cited by examiner

*Primary Examiner* — Renee S Luebke
*Assistant Examiner* — Ahmed Saeed
(74) *Attorney, Agent, or Firm* — Michael A. Glenn; Perkins Coie LLP

(57) ABSTRACT

A luminescent keyswitch module includes a base plate, a keyswitch, a light guide plate, a light source, a diffusion structure, and a reflector. The keyswitch is disposed on the base plate. The light guide plate, disposed under the base plate, has an accommodating space communicated with a through hole of the base plate. The light source passes through the through hole, is accommodated in the accommodating space, and emits light having a first divergence angle. The diffusion structure is accommodated in the accommodating space and located between the light source and the light guide plate. The light passes through the diffusion structure. The light leaving the second light exit surface has a second divergence angle larger than the first divergence angle. The reflector is disposed under the light guide plate, so as to reflect the light to pass through the light guide plate and the base plate to the keyswitch.

18 Claims, 5 Drawing Sheets

LUMINESCENT KEYSWITCH MODULE AND KEYBOARD THEREOF

RELATED APPLICATIONS

This application claims priority to Taiwan Application Serial Number 101216820, filed Aug. 31, 2012, which is herein incorporated by reference.

BACKGROUND

1. Technical Field

The present disclosure relates to a keyswitch and a keyboard including the keyswitch.

2. Description of Related Art

A keyboard is an essential input device for inputting characters or numbers when using a personal computer. Consumer electronics used in daily life or large-scale processing equipment used in industry need input devices having keyswitch structures for operating the consumer electronics products and the processing equipment.

In order to allow visibility when working in dark places, keyboards having LED (light-emitting diode) backlights have been developed, further increasing the great diversity of keyboards. A known configuration involves disposing each of the keyswitches of the keyboard (or each of the keyswitches thereof requiring visibility) on a light-emitting diode.

However, because the conventional illuminated keyboard is configured such that light-emitting diodes are directly disposed on a membrane circuit board and emit light toward keycaps of the keyswitches, uneven light is a problem that easily occurs, thereby greatly reducing the luminous effect of the keycaps. Moreover, the foregoing approach is such that the luminous region of each of the keyswitches is limited within a small area, negatively affecting the visual experience of a user.

SUMMARY

In order to solve the problems of the prior art, the disclosure provides an improved luminescent keyswitch module. The luminescent keyswitch module entails the use backlighting, rather than directly emitting light toward a keycap of a keyswitch, so that the luminous effect obtained by the luminescent keyswitch module is more even. The luminescent keyswitch module of the disclosure further includes a diffusion structure disposed next to a light source, so as to increase the divergence angle of the light emitted by the light source, thereby effectively improving the backlighting quality of the luminescent keyswitch module. Moreover, the reflector of the disclosure is directly mounted to a base plate, but the reflector is not adhered to a light guide plate. Therefore, when the emitted light is reflected to the light guide plate by the reflector, the light is not obscured and the luminous quality is not affected.

According to an embodiment of the disclosure, a luminescent keyswitch module includes a base plate, a keyswitch, a light guide plate, a light source, a diffusion structure, and a reflector. The base plate has a through hole. The keyswitch is disposed on the base plate. The light guide plate is disposed under the base plate and has an accommodating space. The accommodating space is communicated with the through hole. The light source passes through the through hole and is accommodated in the accommodating space. The light source has a first light exit surface and emits light from the first light exit surface. The light that leaves the first light exit surface has a first divergence angle. The diffusion structure is accommodated in the accommodating space and located between the light source and the light guide plate. The diffusion structure has a light entrance surface and a second light exit surface. The light that leaves the first light exit surface then enters the diffusion structure from the light entrance surface and leaves the diffusion structure from the second light exit surface. The light that leaves the second light exit surface has a second divergence angle, and the second divergence angle is larger than the first divergence angle. The reflector is disposed under the light guide plate, so as to reflect the light to sequentially pass through the light guide plate and the base plate to the keyswitch.

In an embodiment of the disclosure, the appearance of the diffusion structure substantially matches the accommodating space, and the light source is sleevedly disposed in the diffusion structure.

In an embodiment of the disclosure, the radius of curvature of the second light exit surface is smaller than the radius of curvature of the light entrance surface.

In an embodiment of the disclosure, the light entrance surface is a planar surface, and the second light exit surface is a curved surface.

In an embodiment of the disclosure, the second divergence angle is smaller than or equal to 160 degrees.

In an embodiment of the disclosure, the reflector is flatly attached to the bottom of the light guide plate and mounted to the bottom of the light source.

In an embodiment of the disclosure, the luminescent keyswitch module further includes a circuit board. The circuit board is disposed on the base plate and covers the through hole for electrically connecting the light source.

In an embodiment of the disclosure, the circuit board is a flexible printed circuit board.

In an embodiment of the disclosure, the luminescent keyswitch module further includes a circuit board. The circuit board is disposed on the base plate and covers the through hole for generating a trigger signal according to a trigger action of the keyswitch and supplying power to the light source.

In an embodiment of the disclosure, the circuit board is a membrane circuit board.

The disclosure provides an improved keyboard.

According to an embodiment of the disclosure, a keyboard includes a base plate, a plurality of keyswitches, a light guide plate, a light source, a diffusion structure, and a reflector. The base plate has a through hole. The keyswitches are disposed on the base plate. The light guide plate is disposed under the base plate and has an accommodating space. The accommodating space is communicated with the through hole. The light source passes through the through hole and is accommodated in the accommodating space. The light source has a first light exit surface and emits light from the first light exit surface. The light that leaves the first light exit surface has a first divergence angle. The diffusion structure is accommodated in the accommodating space and located between the light source and the light guide plate. The diffusion structure has a light entrance surface and a second light exit surface. The light that leaves the first light exit surface then enters the diffusion structure from the light entrance surface and leaves the diffusion structure from the second light exit surface. The light that leaves the second light exit surface has a second divergence angle, and the second divergence angle is larger than the first divergence angle. The reflector is disposed under the light guide plate, so as to reflect the light to sequentially pass through the light guide plate and the base plate to the keyswitches.

In an embodiment of the disclosure, the base plate has at least one extension portion outside of the peripheral edge of the light guide plate. The reflector is flatly attached to the bottom of the light guide plate and mounted to the extension portion.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
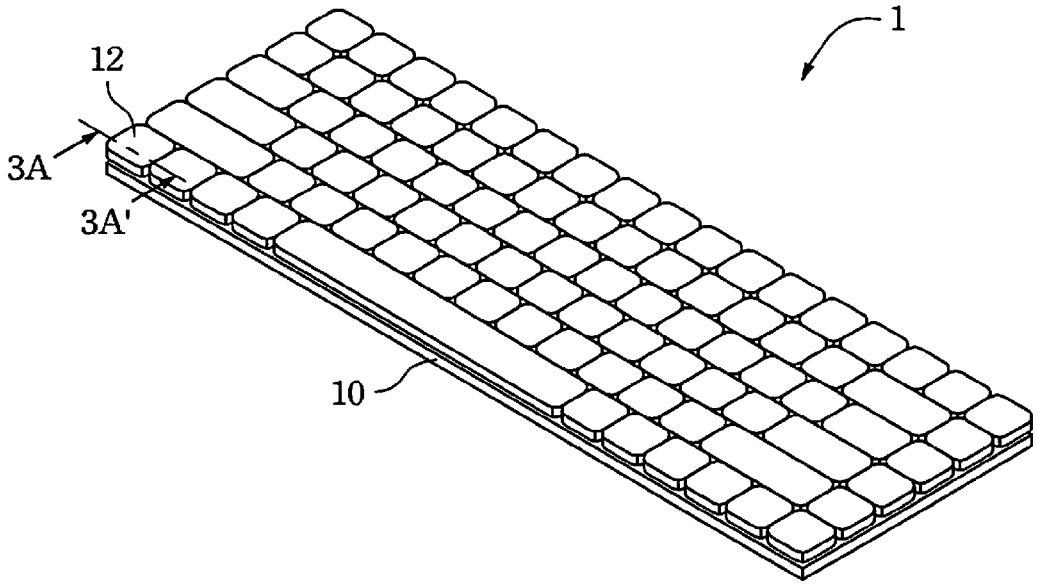
FIG. 1 is a perspective view of a keyboard according to an embodiment of the disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a perspective view of a keyboard 1 according to an embodiment of the disclosure.

As shown in FIG. 1, the keyboard 1 of the disclosure can be an external keyboard (e.g., a keyboard with a PS/2 interface or a keyboard with a USB interface) used in a desktop computer, or can be a part of a computer system having an input device that is in the form of a keyboard (e.g., a notebook computer or a laptop computer), but the disclosure is not limited in this regard. That is, the concepts of the keyboard 1 of the disclosure can be used in any electronic product that adopts luminescent keyswitch modules to be the input interface.

Figure 2:
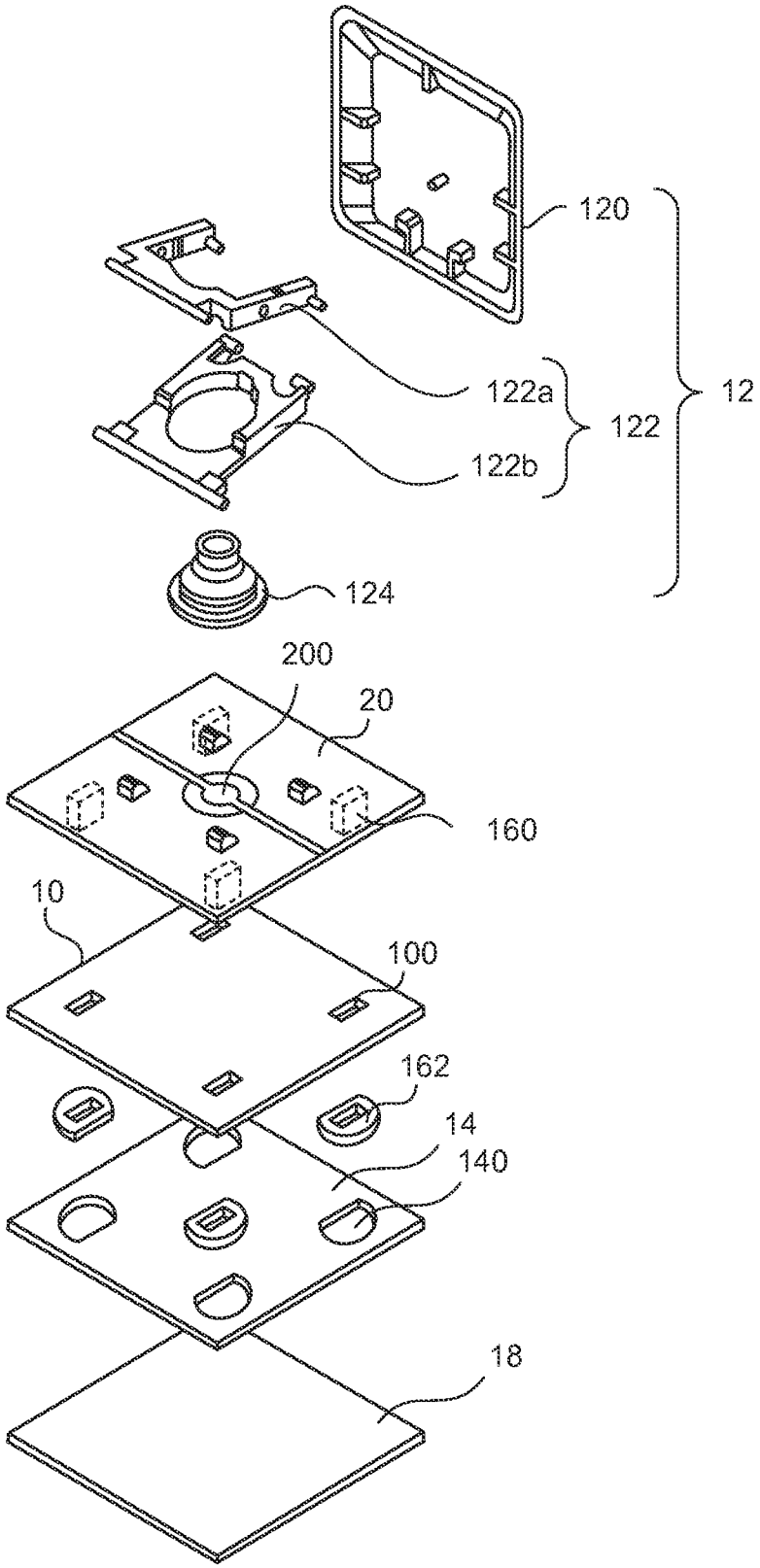
FIG. 2 is an exploded perspective view of a luminescent keyswitch module in FIG. 1.

FIG. 2 is an exploded perspective view of a luminescent keyswitch module in FIG. 1.

As shown in FIG. 1 and FIG. 2, the keyboard 1 includes a base plate 10, a plurality of keyswitches 12, a light guide plate 14, a plurality of light sources 160, a plurality of diffusion structures 162, a reflector 18, and a membrane circuit board 20. The base plate 10 of the keyboard 1 has a plurality of through holes 100. The base plate 10, the light guide plate 14, the light sources 160, the diffusion structures 162, the reflector 18, the membrane circuit board 20, and one of the keyswitches 12 can be regarded as an independent luminescent keyswitch module. The keyswitches 12 of the keyboard 1 are disposed on the base plate 10. The light guide plate 14 of the keyboard 1 is disposed under the base plate 10 and has a plurality of accommodating spaces 140. Each of the accommodating spaces 140 is communicated with one of the through holes 100. Each of the light sources 160 of the keyboard 1 passes through one of the through holes 100, and each of the light sources 160 and one of the diffusion structures 162 are accommodated in one of the accommodating spaces 140. The reflector 18 of the keyboard 1 is disposed under the light guide plate 14. The membrane circuit board 20 of the keyboard 1 is disposed on the base plate 10 and covers the through holes 100. Structures of components included in the keyboard 1 and relationships among the components are described in detail below.

As shown in FIG. 2, the keyswitch 12 of the keyboard 1 includes a keycap 120, a scissors-like supporting structure 122, and a dome 124. The scissors-like supporting structure 122 of the keyswitch 12 is connected between the keycap 120 and the base plate 10, and is formed by a first supporting member 122*a* and a second supporting member 122*b* that are pivotally connected to each other. Through this configuration, the scissors-like supporting structure 122 can support the keycap 120 to vertically move relative to the base plate 10. The membrane circuit board 20 of the keyboard 1 includes a switch 200, and the switch 200 is disposed under the keycap 120 of the keyswitch 12. The dome 124 of the keyswitch 12 is disposed on the base plate 10, passes through the scissors-like supporting structure 122, and is located between the keycap 120 of the keyswitch 12 and the switch 200 of the membrane circuit board 20. The dome 124 of the keyswitch 12 is a resilient member for providing an elastic force so that the keycap 120 of the keyswitch 12 returns to its original position after being pressed. When the keycap 120 of the keyswitch 12 is pressed to move toward the base plate 10, the dome 124 is deformed by the keycap 120 so as to contact the switch 200 of the membrane circuit board 20 (i.e., the dome 124 undergoes a trigger action), and the switch 200 thus generates a trigger signal. The light sources 160 of the keyboard 1 are electrically connected to the membrane circuit board 20 and are supplied with power directly by the membrane circuit board 20.

As shown in FIG. 2, the base plate 10 of the keyboard 1 has four through holes 100 respectively located corresponding to four corners of the keyswitch 12, and the light guide plate 14 correspondingly has four accommodating spaces 140 for accommodating four pairs of light sources 160 and diffusion structures 162. However, the number and positions of the through holes 100 of the base plate 10, the accommodating spaces 140 of the light guide plate 14, the light sources 160, and the diffusion structures 162 are not limited in this regard and can be adjusted according to design requirements or manufacturing limitations (e.g., according to the layout of components).

Figure 3A:
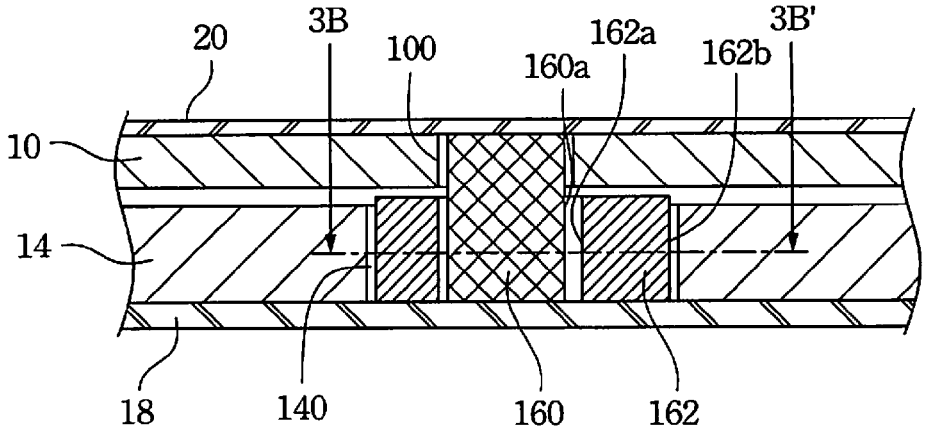
FIG. 3A is a sectional view of the luminescent keyswitch module in FIG. 1 along line 3A-3A'.
Figure 3B:
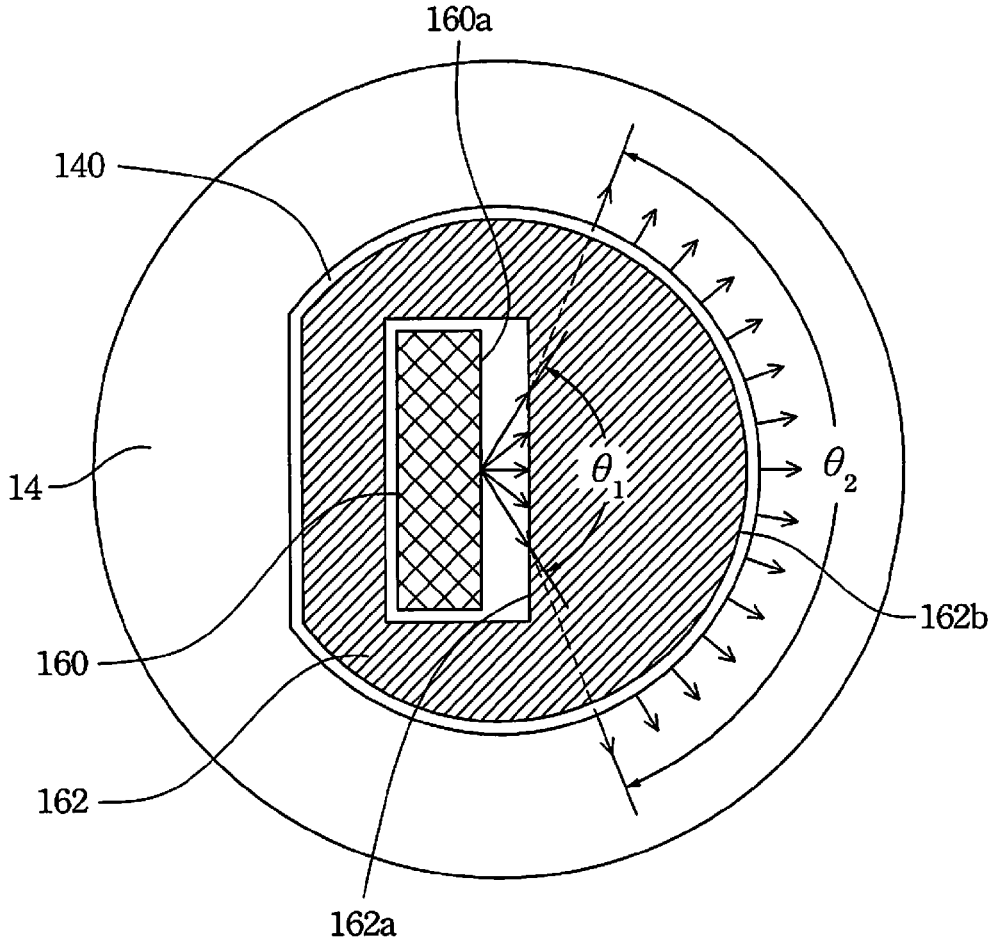
FIG. 3B is a sectional view of the luminescent keyswitch module in FIG. 3A along line 3B-3B'.

FIG. 3A is a sectional view of the luminescent keyswitch module in FIG. 1 along line 3A-3A'. FIG. 3B is a sectional view of the luminescent keyswitch module in FIG. 3A along line 3B-3B'. In the following description, the structure corresponding to one of the light sources 160 will be described.

As shown in FIG. 3A and FIG. 3B, the light source 160 of the keyboard 1 is disposed on the membrane circuit board 20 of the keyboard 1 and is directly supplied power by the membrane circuit board 20. The light source 160 of the keyboard 1 passes through the through hole 100 of the base plate 10 from the membrane circuit board 20 and is accommodated in the accommodating space 140 of the light guide plate 14. The light source 160 of the keyboard 1 has a first light exit surface 160*a*. The light source 160 of the keyboard 1 laterally emits light toward the light guide plate 14 (i.e., substantially along a direction parallel to the base plate 10) from the first light exit surface 160*a*.

In the embodiment of the disclosure, the light source 160 of the keyboard 1 can be disposed on the membrane circuit board 20 by using SMT (Surface Mount Technology), but the disclosure is not limited in this regard.

Furthermore, the first light exit surface 160*a* of the light source 160 is substantially perpendicular to the light guide plate 14, and the light that leaves the first light exit surface 160*a* has a first divergence angle $\theta_1$. The diffusion structure 162 of the keyboard 1 is accommodated in the accommodating space 140 and located between the base plate 10 and the reflector 18. In the embodiment of the disclosure, the light source 160 of the keyboard 1 is sleevedly disposed in the diffusion structure 162, and the diffusion structure 162 has a light entrance surface 162*a* and a second light exit surface 162*b*. After leaving the first light exit surface 160*a* of the light source 160, the light enters the diffusion structure 162 from the light entrance surface 162*a* and leaves the diffusion structure 162 from the second light exit surface 162*b*. Afterwards, the light that leaves the second light exit surface 162*b* of the diffusion structure 162 then enters the light guide plate 14.

As shown in FIG. 3B, the light entrance surface 162*a* and the second light exit surface 162*b* of the diffusion structure 162 have different radiuses of curvature, so the light that leaves the second light exit surface 162*b* has a second divergence angle $\theta_2$ (according to principles of light refraction). In the embodiment of the disclosure, the first light exit surface 160*a* of the light source 160 is a planar surface, the light entrance surface 162*a* of the diffusion structure 162 is a planar surface, and the second light exit surface 162*b* is a curved surface, but the disclosure is not limited in this regard. As long as the shape of the light entrance surface 162*a* of the diffusion structure 162 substantially matches the shape of the first light exit surface 160*a* of the light source 160, and the radius of curvature of the second light exit surface 162*b* of the diffusion structure 162 is smaller than the radius of curvature of the light entrance surface 162*a*, the second divergence angle $\theta_2$ will be larger than the first divergence angle $\theta_1$. For example, if the first divergence angle $\theta_1$ of the light that leaves the first light exit surface 160*a* is 120 degrees, the second divergence angle $\theta_2$ of the light that leaves the second light exit surface 162*b* of the diffusion structure 162 can be larger than 120 degrees and smaller than or equal to 160 degrees by appropriately adjusting the radiuses of curvature of the light entrance surface 162*a* and the second light exit surface 162*b* of the diffusion structure 162, but the disclosure is not limited in this regard. Furthermore, the shape of the diffusion structure 162 of the keyboard 1 substantially matches the accommodating space 140, and such a configuration allows for easy and mistake-free assembly.

In the embodiment of the disclosure, only one diffusion structure 162 of the keyboard 1 is accommodated in the corresponding space 140 of the light guide plate 14, but the disclosure is not limited in this regard. In order to be applied to light guide plates with different thicknesses, in another embodiment of the disclosure, thin diffusion structures (e.g., 0.32 mm in thickness) can be manufactured, and a plurality of the thin diffusion structures can be stacked and accommodated in the accommodating space 140 in accordance with the thickness of the light guide plate 14. Therefore, greater flexibility is realized when such thin diffusion structures need to be applied to light guide plates of varying thicknesses.

As shown in FIG. 3A, the reflector 18 of the keyboard 1 is flatly attached to the light guide plate 14 and mounted to the bottom of the light source 160. In order to ensure such a configuration in which the reflector 18 is flatly attached to the bottom of the light guide plate 14, the thickness of the light source 160 is substantially equal to the sum of the thicknesses of the base plate 10 and the light guide plate 14, so that the portion of the reflector 18 corresponding to the light source 160 is substantially flat without protruding toward or away from the light source 160. Therefore, when the emitted light is reflected to the light guide plate 14 by the reflector 18, the luminous quality is not affected because the reflector 18 is flat.

In the embodiment of the disclosure, the light sources 160 of the keyboard 1 are electrically connected to the membrane circuit board 20, the primary function of which is to generate trigger signals, but the disclosure is not limited in this regard. In another embodiment of the disclosure, the keyboard 1 can further include a flexible printed circuit board (not shown). The flexible printed circuit board of the keyboard 1 can be disposed on the base plate 10 and cover the through holes 100 of the base plate 10. The primary function of the flexible printed circuit board is to supply power to the light sources 160, and the flexible printed circuit board and the foregoing membrane circuit board 20 operate independently.

In the embodiment of the disclosure, the light sources 160 of the keyboard 1 are LEDs (Light Emitting Diodes), but the disclosure is not limited in this regard.

Figure 4A:
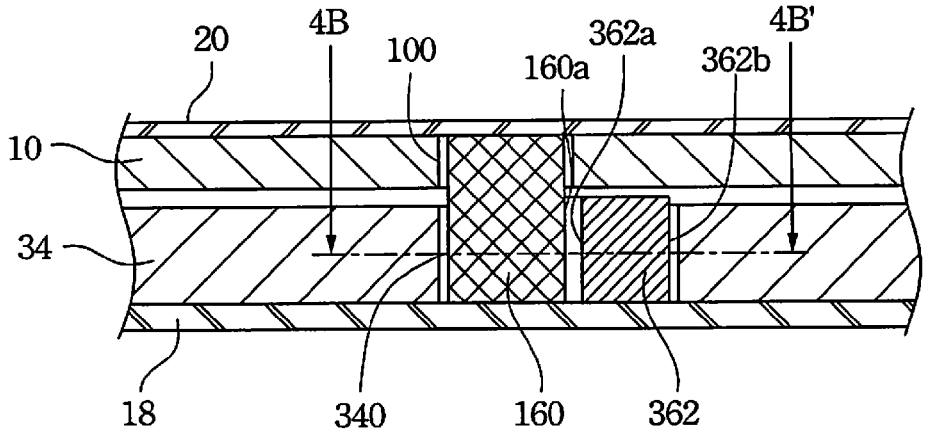
FIG. 4A is another sectional view of the luminescent keyswitch module in FIG. 1 along line 3A-3A' according to another embodiment of the disclosure.
Figure 4B:
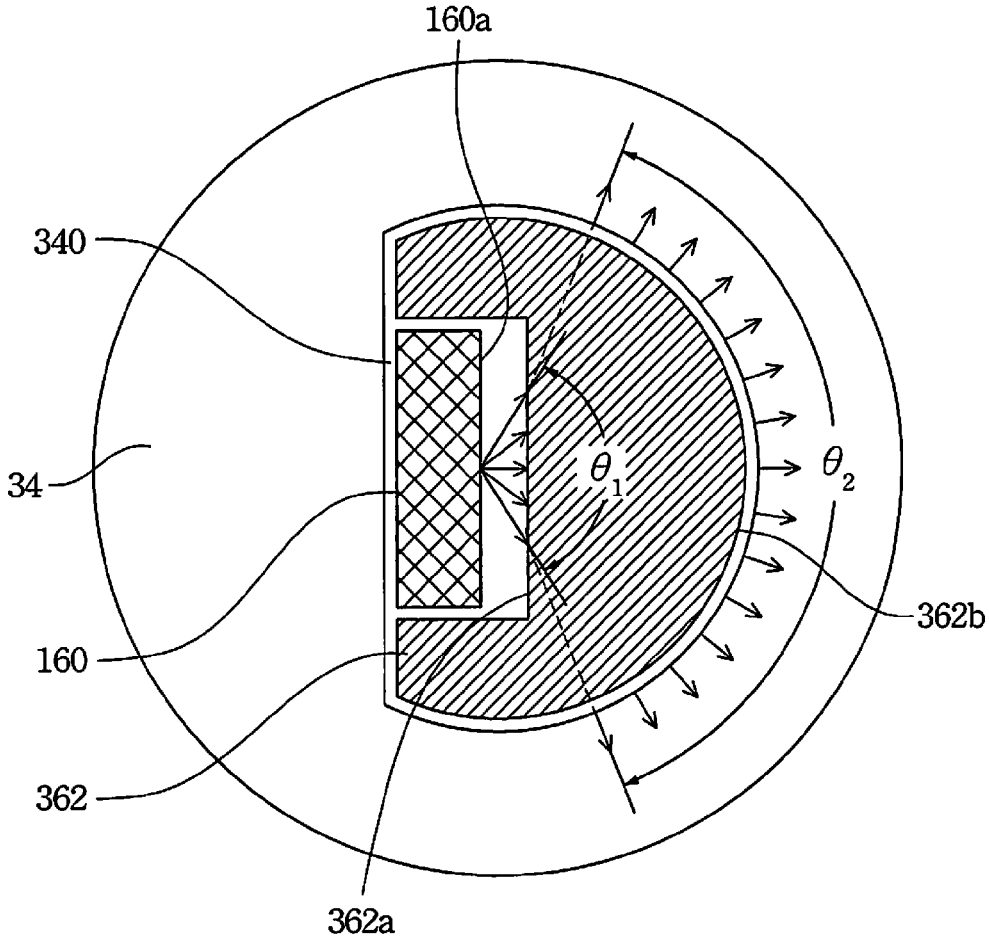
FIG. 4B is a sectional view of the luminescent keyswitch module in FIG. 4A along line 4B-4B'.

FIG. 4A is another sectional view of the luminescent keyswitch module in FIG. 1 along line 3A-3A' according to another embodiment of the disclosure. FIG. 4B is a sectional view of the luminescent keyswitch module in FIG. 4A along line 4B-4B'.

As shown in FIG. 4A and FIG. 4B, the luminescent keyswitch module includes a base plate 10, a reflector 18, and a membrane circuit board 20. Since the functions of these elements have been described in the above embodiment with reference to FIG. 3A, an explanation in this regard will not be repeated. The embodiment in FIG. 4A and FIG. 4B is particularly directed to a modification of a light guide plate 34 and a diffusion structure 362.

As shown in FIG. 4A and FIG. 4B, the light source 160 is disposed on the membrane circuit board 20 and power is supplied directly thereto by the membrane circuit board 20. The light source 160 passes through the through hole 100 of the base plate 10 from the membrane circuit board 20 and is accommodated in the accommodating space 340 of the light guide plate 34. The light source 160 has a first light exit surface 160*a*. The light source 160 laterally emits light toward the light guide plate 34 from the first light exit surface 160*a*. The first light exit surface 160*a* of the light source 160 is substantially perpendicular to the light guide plate 34, and the light that leaves the first light exit surface 160*a* has a first divergence angle $\theta_1$. The diffusion structure 362 is accommodated in the accommodating space 340 and located between the base plate 10 and the reflector 18. In the embodiment of the disclosure, the diffusion structure 362 is located between the light source 160 and the light guide plate 34, and has a light entrance surface 362*a* and a second light exit surface 362*b*. After leaving the first light exit surface 160*a* of the light source 160, the light enters the diffusion structure 362 from the light entrance surface 362*a* and leaves the diffusion structure 362 from the second light exit surface 362*b*. Afterwards, the light that leaves the second light exit surface 362*b* of the diffusion structure 362 then enters the light guide plate 34.

In other words, the light source 160 of the keyboard 1 is not sleevedly disposed in the diffusion structure 362. Therefore, the size of the accommodating space 340 of the light guide plate 34 and that of the diffusion structure 362 can be reduced, so as to reduce material costs. The shape of the diffusion structure 362 substantially matches the accommodating space 340 of the light guide plate 34, and such a configuration allows for easy and mistake-free assembly.

Furthermore, the light entrance surface 362*a* and the second light exit surface 362*b* of the diffusion structure 362 have different radiuses of curvature, so the light that leaves the second light exit surface 362*b* has a second divergence angle $\theta_2$ (according to principles of light refraction), and the second divergence angle $\theta_2$ is larger than the first divergence angle $\theta_1$.

Figure 5:
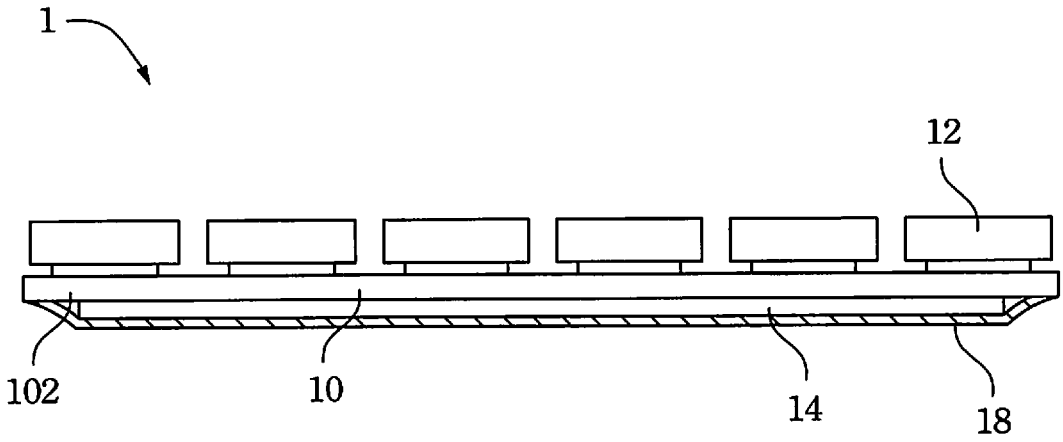
FIG. 5 is a side view of the keyboard in FIG. 1, in which a reflector is illustrated in cross section.

FIG. 5 is a side view of the keyboard 1 in FIG. 1, in which the reflector 18 is illustrated in cross section.

As shown in FIG. 5, the base plate 10 of the keyboard 1 has at least one extension portion 102 (i.e., the portions of the base plate 10 that protrude outward from two edges of the light guide plate 14 in FIG. 5) outside of the peripheral edge of the light guide plate 14. The reflector 18 of the keyboard 1 is flatly attached to the bottom of the light guide plate 14 and mounted to the extension portion 102. That is, the reflector 18 of the disclosure is directly mounted to the extension portion 102 of the base plate 10, but the reflector 18 is not adhered to a light guide plate 14. Therefore, when the emitted light is reflected to the light guide plate 14 by the reflector 18, the light is not obscured and the luminous quality is not affected.

According to the foregoing recitations of the embodiments of the disclosure, it can be seen that the luminescent keyswitch module and the keyboard thereof involve the use of backlighting, rather than directly emitting light toward a keycap of a keyswitch, so that the luminous effect obtained by the luminescent keyswitch module is more even. The luminescent keyswitch module of the disclosure further includes a diffusion structure disposed next to a light source, so as to increase the divergence angle of the light emitted by the light source, thereby effectively improving the backlighting quality of the luminescent keyswitch module. Moreover, the reflector of the disclosure is directly mounted to a base plate, but the reflector is not adhered to a light guide plate. Therefore, when the emitted light is reflected to the light guide plate by the reflector, the light is not obscured and the luminous quality is not affected.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A luminescent keyswitch module comprising:

a base plate having a through hole;

a keyswitch disposed on the base plate;

a light guide plate disposed under the base plate and having an accommodating space, wherein the accommodating space is communicated with the through hole;

a light source passing through the through hole and accommodated in the accommodating space, the light source having a first light exit surface and emitting light from the first light exit surface, and the light leaving the first light exit surface having a first divergence angle;

a diffusion structure accommodated in the accommodating space and located between the light source and the light guide plate, the diffusion structure having a light entrance surface and a second light exit surface, the light leaving the first light exit surface then entering the diffusion structure from the light entrance surface and leaving the diffusion structure from the second light exit surface, wherein the light leaving the second light exit surface has a second divergence angle, and the second divergence angle is larger than the first divergence angle, wherein the shape of the diffusion structure substantially matches the accommodating space, and the light source is sleevedly disposed in the diffusion structure; and a reflector disposed under the light guide plate, so as to reflect the light to sequentially pass through the light guide plate and the base plate to the keyswitch.

2. The luminescent keyswitch module of claim 1, wherein the radius of curvature of the second light exit surface is smaller than the radius of curvature of the light entrance surface.

3. The luminescent keyswitch module of claim 2, wherein the light entrance surface is a planar surface, and the second light exit surface is a curved surface.

4. The luminescent keyswitch module of claim 1, wherein the second divergence angle is smaller than or equal to 160 degrees.

5. The luminescent keyswitch module of claim 1, wherein the reflector is flatly attached to the bottom of the light guide plate and mounted to the bottom of the light source.

6. The luminescent keyswitch module of claim 1, further comprising a circuit board disposed on the base plate and covering the through hole for electrically connecting the light source.

7. The luminescent keyswitch module of claim 6, wherein the circuit board is a flexible printed circuit board.

8. The luminescent keyswitch module of claim 1, further comprising a circuit board disposed on the base plate and covering the through hole for generating a trigger signal according to a trigger action of the keyswitch and supplying power to the light source.

9. The luminescent keyswitch module of claim 8, wherein the circuit board is a membrane circuit board.

10. A keyboard comprising:

a base plate having a through hole;

a plurality of keyswitches disposed on the base plate;

a light guide plate disposed under the base plate and having an accommodating space, wherein the accommodating space is communicated with the through hole;

a light source passing through the through hole and accommodated in the accommodating space, the light source having a first light exit surface and emitting light from the first light exit surface, and the light leaving the first light exit surface having a first divergence angle;

a diffusion structure accommodated in the accommodating space and located between the light source and the light guide plate, the diffusion structure having a light entrance surface and a second light exit surface, the light leaving the first light exit surface then entering the diffusion structure from the light entrance surface and leaving the diffusion structure from the second light exit surface, wherein the light leaving the second light exit surface has a second divergence angle, and the second divergence angle is larger than the first divergence angle, wherein the shape of the diffusion structure substantially matches the accommodating space, and the light source is sleevedly disposed in the diffusion structure; and a reflector disposed under the light guide plate, so as to reflect the light to sequentially pass through the light guide plate and the base plate to the keyswitches.

11. The keyboard of claim 10, wherein the radius of curvature of the second light exit surface is smaller than the radius of curvature of the light entrance surface.

12. The keyboard of claim 11, wherein the light entrance surface is a planar surface, and the second light exit surface is a curved surface.

13. The keyboard of claim 10, wherein the second divergence angle is smaller than or equal to 160 degrees.

14. The keyboard of claim 10, further comprising a circuit board disposed on the base plate and covering the through hole for electrically connecting the light source.

15. The keyboard of claim 14, wherein the circuit board is a flexible printed circuit board.

16. The keyboard of claim 10, wherein the base plate has at least one extension portion outside of the peripheral edge of the light guide plate, and the reflector is flatly attached to the light guide plate and mounted to the extension portion.

17. The keyboard of claim 10, further comprising a circuit board disposed on the base plate and covering the through hole for generating a trigger signal according to a trigger action of the keyswitch and supplying power to the light source.

18. The keyboard of claim 17, wherein the circuit board is a membrane circuit board.

* * * * *